United States Patent [19]

Heaney

[11] 3,986,742

[45] Oct. 19, 1976

[54] DOOR STOP AND HOLD OPEN DEVICE

[75] Inventor: James J. Heaney, Glendale, Calif.

[73] Assignee: Anthony's Manufacturing Company, Inc., San Fernando, Calif.

[22] Filed: Oct. 8, 1975

[21] Appl. No.: 620,859

[52] U.S. Cl. ..... 292/268; 16/49; 16/82; 16/86 A; 16/86 B

[51] Int. Cl.[2] ..... E05C 17/16

[58] Field of Search ..... 292/268, 270, 275, 278; 16/49, 86, 82

[56] References Cited

UNITED STATES PATENTS

| | | | |
|---|---|---|---|
| 1,942,860 | 1/1934 | Hummert | 292/275 |
| 2,958,089 | 11/1960 | Roehm et al. | 16/49 |
| 3,144,267 | 8/1964 | Schmid | 292/275 |
| 3,164,404 | 1/1965 | Arnold | 292/273 |
| 3,601,842 | 8/1971 | Morrison | 292/274 |
| 3,724,129 | 4/1973 | Stromquist | 49/70 |

FOREIGN PATENTS OR APPLICATIONS

| | | | |
|---|---|---|---|
| 632,629 | 11/1949 | United Kingdom | 292/268 |

*Primary Examiner*—Werner H. Schroeder
*Assistant Examiner*—Conrad L. Berman
*Attorney, Agent, or Firm*—Kleinberg, Morganstern, Scholnick & Mann

[57] ABSTRACT

A door stop and hold open for use in refrigerated display cabinets includes a selectively positionable arrestor for limiting the swing of the door and for detenting the door in its widest open position. Detenting action is provided by a clip having two leaf springs between which a pin is forced as the opening door approaches its limiting position, and by which the pin is yieldably retained. The leaf springs are shaped to provide rigidity except in the direction of spreading and to provide a large surface area for contacting the pin, thereby reducing wear.

16 Claims, 6 Drawing Figures

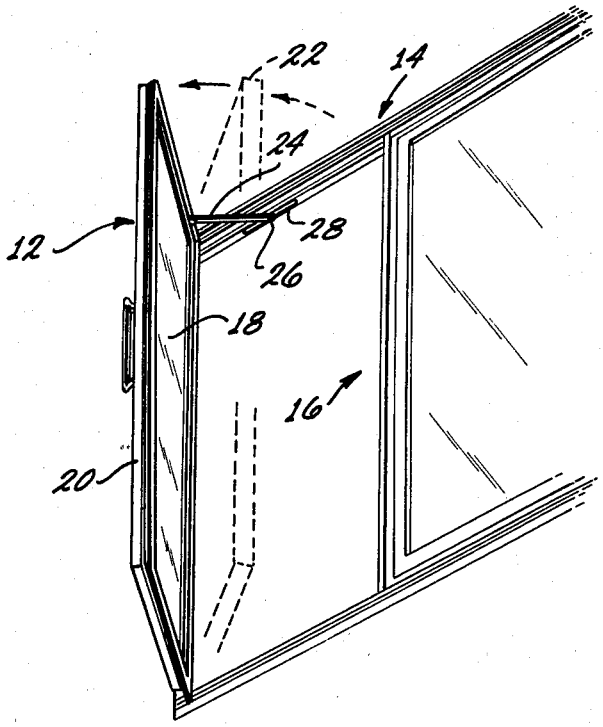
FIG. 1
FIG. 2
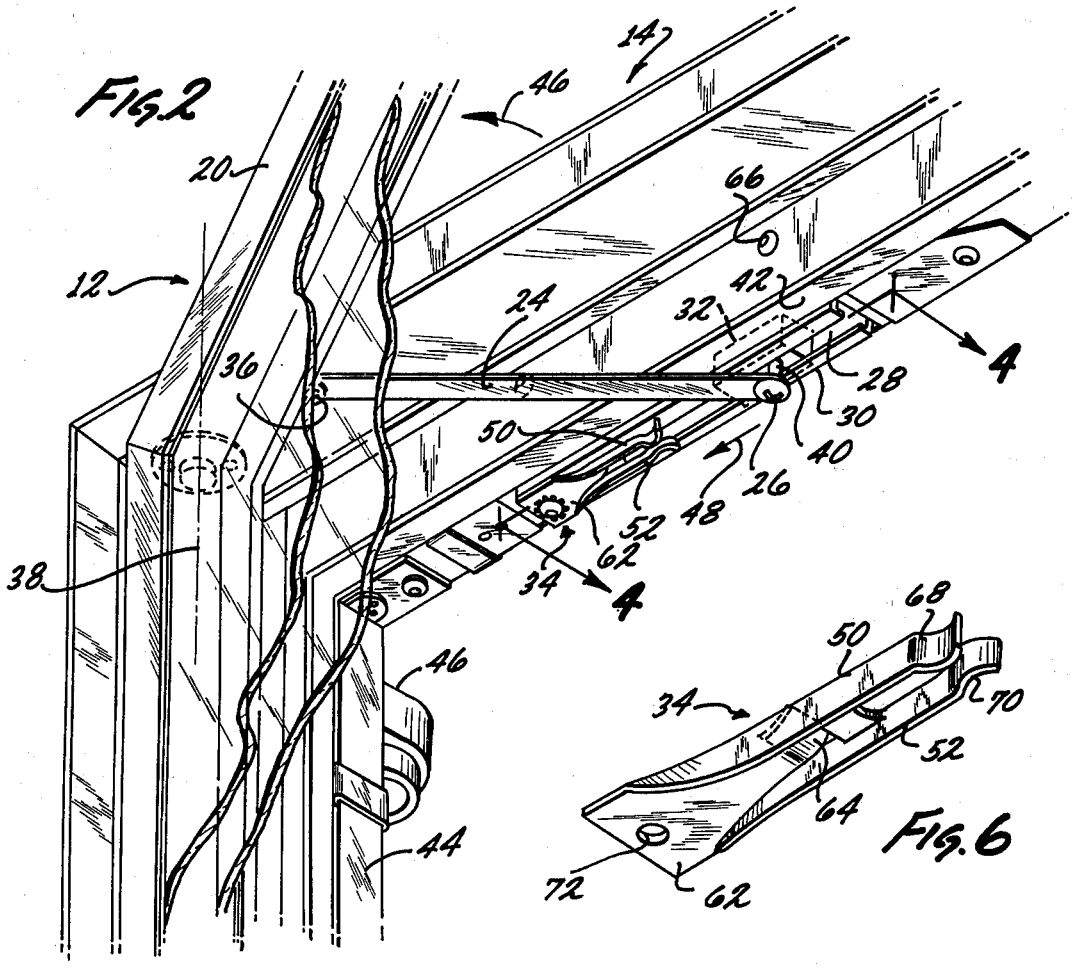
FIG. 6

FIG. 3
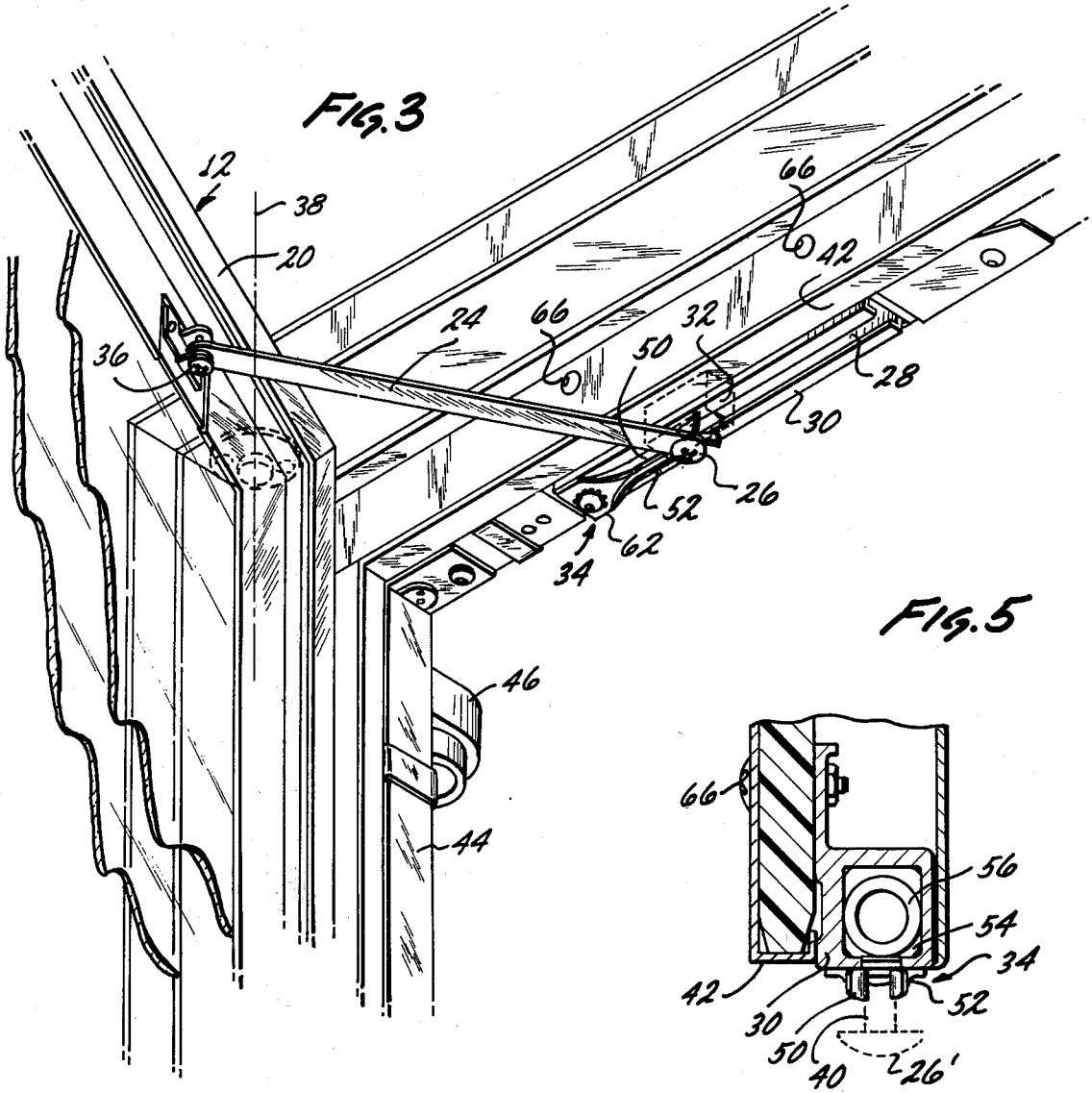
FIG. 5
FIG. 4
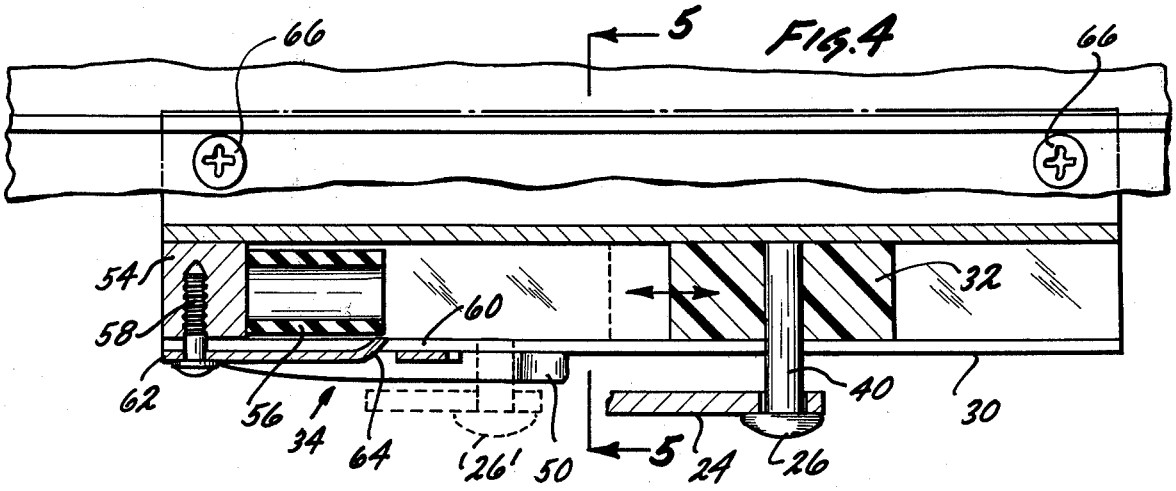

DOOR STOP AND HOLD OPEN DEVICE

BACKGROUND OF THE INVENTION

1. Field of the Invention

The present invention is in the field of refrigerated cabinet doors, and specifically relates to devices for holding such doors in a desired open position.

2. The Prior Art

The doors of a refrigerated display cabinet are generally urged shut by torsion springs to prevent them from being inadvertently left in the open position with consequent inflow of warm air. Nevertheless, it is desirable to retain the door in an open position when the cabinet is being stocked from the front. Further, shoppers carrying packages find it more convenient if the door can be held in an open position while they are removing merchandise from the cabinet. Thus, the present invention is directed to a device which holds the door in a selectible open position but which otherwise does not interfere with its normally urged closed operation.

A number of hold open mechanisms are known in the art. The most elementary type of hold open consists of a wedge or a block member inserted between the door frame and the door mounting frame in the vicinity of the hinge axis. Because of this location, the devices are subject to great forces owing to the leverage exerted on them by the forces applied to the door. As a result, such devices may damage the door frame, the door mounting frame, and/or the hinges. Certain prior art devices must be manually set into position each time the door is to be held open. This is obviously undesirable if the hold open is used with any frequency.

A more sophisticated hold open known in the prior art uses an arm which is pivoted to the door frame some distance from the hinge axis for rotation in a plane perpendicular to the hinge axis and whose other end is connected to a pin which slides in a channel mounted in or on the door mounting frame. As the door is opened, the pin slides along the channel toward the hinge axis, and it is known in the art to provide one or more slots in the edge of the channel into which the pin can be urged to hold the door open at a designated angle.

A particular hold open of the type just described further comprises an arrestor attached to the channel for limiting the motion of the door and for detenting it in the widest open position. The arrestor includes a slotted planar sheet metal detent attached to the end of the channel nearest the hinge axis with its slot aligned with the channel, and having a portion at its end nearest the hinge axis bent around the end of the channel to prevent misalignment of the slot with the channel. Because a portion of the sheet metal detent is bent around the end of the channel, it is not convenient to alter the position of the arrestor along the channel to selectively vary the widest open position of the door.

The edges of the slot in the sheet metal detent define a guideway extending along the channel. The edges of the slot are arched inwardly toward each other over a portion of their length to define a constricted portion in the guideway. The width of this constricted portion is required to be slightly less than the width of the pin. As the pin moves along the channel, it enters the guideway, and upon encountering the constricted portion of this guideway, it forces the edges of the slot apart, deforming the sheet metal detent. After the pin has passed the constricted area, the edges of the slot spring together thereby yieldably retaining the pin within the slot. Forces applied to the door in closing it are normally sufficient to overcome the opposition of the detent.

The opposition of the detent slot to motion of the pin serves to warn the person opening the door that the hold open position is being approached, and it further serves to dissipate the momentum of the swinging door.

This type of device is useful in applications where the door is not opened to its detented position very frequently. However, in those applications where the door is opened to its detented position many times each day, it has been found that the edges of the planar sheet metal detent slot and the pin body engaging are both worn away owing to the substantial contact pressures produced as the pin engages the edges of the slot spreading them. As a result, the useful life of the device is shortened.

Another drawback resulting from the excessive stiffness of the planar sheet metal detent in resisting spreading is the necessity for closely controlling the width of the slot relative to the width of the pin. If the slot is undersize, excessive force will be required to drive the pin into the slot, while if the slot is too large, it will not either adequately oppose the motion of the pin or hold the door in an open position.

There is therefore need for a door hold open mechanism that can be used potentially hundreds of times each day without incurring excessive wear or requiring components to be held to precise tolerances.

SUMMARY

The hold open of the present invention incorporates a novel arrestor member which results in a longer useful life, eases the manufacturing tolerances, and which permits convenient adjustment of the position at which the door is held open.

The hold open of the present invention includes a preferably rectangular channel for mounting to a member of the door mounting frame with the channel parallel to the length axis of the member and having a guide slot extending through the channel on the side of it which faces the center of the door mounting frame. Within the channel there is a movable block, slidable along the channel and having a pin extending through the slot in the wall of the channel. An arm member is pivotally attached at one of its ends to the pin carried by the slidable block, while the other end of the arm is pivotally pinned to a member of the door frame. As the door is opened, the arm drags the slidable block along the inside of the channel toward the hinge axis.

At a location within the channel between the slidable block and the hinge axis there is located a selectively positionable stop member for stopping the motion of the slidable block. A resilient bumper located between the fixed stop member and the slidable block assists in absorbing the shock of the impact.

Proximate to the channel on its slotted wall, there is provided a detent including a plate-like portion. A screw which extends through a hole in the plate-like portion of the detent and which extends through the slot in the wall of the channel attaches the plate-like portion to the stop member inside the channel. When the screw has been tightened, the wall of the channel is clamped securely between the plate-like portion of the detent and the stop member. The stop member and the detent is thus fixed in position relative to the channel.

Thus, the door stop and hold open of the present invention is selectively positionable along the channel.

The plate-like portion of the detent terminates at one end in two leaf springs which extend along the slot of the channel in a direction away from the hinge axis of the door. The purpose of these leaf springs is to provide a detenting action for the door. To accomplish this, they define a guideway extending along the channel and having a constricted portion where the leaf springs are arched toward each other. As the pin attached to the slidable block moves along the slot in the channel, it enters the guideway formed by the leaf springs, and upon encountering the constricted portion of this guideway it forces the leaf springs apart, thereby encountering some resistance to its forward motion.

After the pin has passed the constricted area, the leaf springs move toward one another, resuming their initial condition. At this point, the pin is yieldably retained between the leaf springs; a predetermined force is required to withdraw the pin through the constricted space defined by the leaf springs in order to close the door from its detented position. A tab portion of the detent is positioned within the guide slot to retain alignment of the detent and the guide slot.

Thus, the present invention provides a selectively positionable door stop and hold open which includes a detent for yieldably holding the door at its widest open position against the door stop. Because of the relatively large contact area between the wide faces of the leaf springs and the moving pin, wearing of the parts is minimized and dimensional tolerances are greatly relaxed.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a perspective view showing how the hold open of the present invention is associated with the other parts of the door;

FIG. 2 is a detailed perspective view of the present invention with the door partly open;

FIG. 3 is a detailed perspective view of the present invention with the door in its widest open position;

FIG. 4 is a side view partially in section of a preferred embodiment of the arrestor of the present invention;

FIG. 5 is an end cross-sectional view of a preferred embodiment of the arrestor of the present invention; and FIG. 6 is a perspective view of a preferred embodiment of a detent of the present invention.

DESCRIPTION OF THE PREFERRED EMBODIMENT

Referring now to the drawings, there is shown in FIG. 1 a refrigerated cabinet door and door mounting frame of the type described in U.S. Pat. No. 3,724,129 to Stromquist in which a door 12 is pivotally mounted within a door mounting frame 14 to permit access to the merchandise displayed within the refrigerated cabinet 16 (not shown). The door 12 usually includes a central glazed area 18 enclosed in a door frame 20. As the door is opened from its normally closed position flush with the door mounting frame 14, through an intermediate position 22 shown by phantom lines, to a more widely opened position, arm 24, pivotally attached to door frame 20 draws pin 26 along slot 28. This action enables operation of the door stop and hold described below.

FIG. 2 is a perspective view showing the parts of FIG. 1 in greater detail with like numbers referring to like parts. In the preferred embodiment shown in FIG. 2, channel 30 is mounted alongside of door mounting frame member 42 on the inside surface of member 24 so that slot 28 of channel 30 is substantially flush with the lower surface of member 24. Groove 28 extends substantially parallel to the longitudinal axis of door mounting frame member 24. Block 32 is slidably positioned inside channel 30. Pin 26 is attached to block 32. Arm 24 is pivotally attached at a first end to door frame 20 by pin 36. The other end of arm 24 is pivotally connected to pin 26. Detent member 34 is selectively affixed to channel 30 at a position between the closed door position of slidable block 32 and hinge line 38 of the door 12. A wiring conduit 44 and a fluorescent lamp fixture 46 may also be attached to door mounting frame member 42 on its inwardly facing surface. As door 12 is pivotally opened by rotation about hinge line 38 in the direction 46, slidable block 32, including pin 26 are drawn along slot 28 of channel 30 in the direction 48.

This motion continues as the door is opened until the door reaches a predetermined position shown in FIG. 3. In that position, pin 26 has been forced between leaf springs 50 and 52 of detent member 34 forcing the leaf spring apart. Pin 26 is thus yieldably retained between leaf springs 50 and 52, thereby holding the door in its widest open position. In the preferred embodiment of FIGS. 2 and 3, pin 26 has a shank portion 40 (as best seen in FIG. 5) for engaging leaf springs 50 and 52. Gravity causes arm 24 to ride against the head of pin 26, thereby providing adequate clearance for leaf springs 50 and 52 to engage shank portion 40. In alternate embodiments, this could be accomplished by providing shank portion 40 with a bushing for holding arm 24 against the head of pin 26.

FIG. 4 is a side view, partially in cross-section of the arrestor used in a preferred embodiment of the present invention. In addition to the parts already described, in FIG. 4 can be seen a selectively positionable stop member 54 and a resilient bumper 56. As the door is opened, slidable block 32 is drawn toward stop member 54 and contacts resilient bumper 56 at substantially the position shown in the detented position 26' (shown in dashed lines in FIG. 4). Resilient bumper 56 thus prevents an impact between the approaching generally non-resilient parts 54 and 32. As best seen in FIG. 6, detent member 34 has a plate-like portion 62 which (as seen in FIG. 4) is affixed to block 54 by screw 58 which passes through slot 28 in channel 30 thereby clamping lip 60 of channel 30 between stop member 54 and plate portion 62 of detent member 34. In a preferred embodiment stop member 54 may be an aluminum block having a threaded hole to receive screw 58. This clamping arrangement permits the selective positioning of stop member 54 and detent member 34 along the length of channel 30. This permits adjustment of the angle of door detent.

FIG. 5 is a cross-section end view of the arrestor shown in FIG. 4. In the preferred embodiment shown in FIG. 5, the channel 30 is attached to door mounting frame member 42 by bolts 66. Channel 30 and detent member 34 preferably extend slightly below the lower surface of door mounting frame member 42.

FIG. 6 is a perspective view of detent member 34. In the preferred embodiment of the present invention detent member 34 is a unitary structure including a plate-like portion 62 having a tab portion 64 depressed below the plane of portion 62 for protruding into slot 28 of channel 30. This assures that detent member 34 remains properly aligned with respect to channel 30. Detent member 34 further includes two leaf spring portions 50 and 52 integral with the plate portion 62 and extending from it at one end. Leaf springs 50 and 52 extend substantially parallel to each other and substantially parallel to slot 28 in channel 30.

Near their free ends leaf springs 50 and 52 have portions 68 and 70, respectively, arched inwardly towards one another thereby forming a constriction in the space between the leaf springs. The width of this constricted area is less than the width of shank portion 40 of pin 26. Thus, a moderate force is required to draw pin 26 into the guideway between leaf springs 50 and 52. This in turn serves to warn that the limit position is being approached and also serves to dissipate some of the momentum of the swinging door. Once pin 26 has passed the constricted area between portions 68 and 70 of leaf springs 50 and 52, it is yieldably retained bewteen the leaf springs giving the desired hold open action.

Because the cross-sections of leaf springs 50 and 52 have their major dimensions perpendicular to plate portion 62 and have their minor dimensions in a lateral direction transverse the groove 28, the leaf springs 50 and 52 are well adapted for deflection in the lateral direction but are substantially rigid in other directions. Further, because of their shape, leaf springs 50 and 52 provide a relatively large surface area for contacting shank portion 40 of pin 26. As a result, there is little tendency for the pin or for the leaf springs to wear, even with heavy usage.

Thus, there has been described a preferred embodiment of a door stop and hold open including an arrestor unit having a novel detent member which is selectively positionable and which significantly reduces wear of the parts.

Although the preferred embodiment shows the stop and hold open installed on the upper horizontal door frame member, it is clear, that the invention could be installed on the lower door mounting frame equally well. Also, if the hinge axis of the door were horizontal, the invention would be installed in the vertical members of the door mounting frame.

It is also apparent that the arrestor portion of the invention could be installed on the door frame rather than on the door mounting frame. In this case, one end of arm 24 would be pivotally attached to the door mounting frame member 42 for rotation about an axis parallel to the hinge axis of the door.

In still other embodiments, the channel 30 may be an integral part of door mounting frame member 24. Variations of detent member 34 within the spirit of the invention are also suggested. For example, the relative positions of tab 64 and screw hole 72 could be reversed and detent member 34 could be installed within the channel 30 rather than on its outside surface. Some detenting action would also be obtainable with only a single leaf spring.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A door stop and hold open affixable to a door mounting frame and to a door hinged from the door mounting frame to pivot about an axis from a normally closed position to an open position, for limiting the extent of the pivotal motion and for detenting the door frame at a selected open position, comprising:

a. a channel, affixable to a member of the door mounting frame which is perpendicular to the hinge axis, with the channel parallel to the longitudinal axis of the member, and having a guide slot extending along the wall of the channel;

b. a slidable block, positioned inside the channel and slidable along it, said block having a pin extending through the guide slot of said channel;

c. an arm pivotally connected at a first end to the pin of said slidable block and pivotally connected at its other end to the door at a point removed from the door hinge axis;

d. a stop member selectively positioned at a point within the channel between the slidable block and the door hinge axis to limit the travel of the slidable block within the channel; and e. a detent member having orthogonal longitudinal and lateral axes and being selectively positioned proximate the slotted wall of said channel with the longitudinal axis parallel to the said channel guide slot and the lateral axis transverse to said channel guide slot, said detent member comprising a plate portion having a tab depressed to extend partially into the guide slot of the channel to maintain alignment of the detent member with respect to the channel guide slot, and further comprising at least one leaf spring integral with said plate portion, and extending substantially in the longitudinal direction so that when said detent member is attached to said channel said at least one leaf spring extends away from the hinge axis along and aligned with said channel, said at least one leaf spring having an arch portion normally extending into the path of said pin along said guide slot so that the pin contacts said arch portion as it moves within said channel guide slot corresponding to a desired detent position of the door, said at least one leaf spring being substantially resilient but having sufficient rigidity to prevent said pin from being pulled past it in the absence of external forces manually applied to the door.

2. The door stop and hold open of claim 1 wherein said detent member has two leaf springs integral with said plate portion, substantially parallel to each other and extending substantially in the longitudinal direction so that when said detent member is attached to said channel the leaf springs extend away from the hinge axis along and aligned with said channel guide slot, the opposing surfaces of said leaf springs defining a guideway between them, said leaf springs having an arched portion normally extending into the path of said pin along said guide slot so that the pin contacts said arched portions as it moves within said channel guide slot, corresponding to a desired detent position of the door, said leaf springs being substantially resilient but having sufficient rigidity to prevent said pin from being pulled past it in the absence of external forces manually applied to the door.

3. The door stop and hold of claim 1 wherein said arch portion has a surface contacted by the pin as it moves within said channel, said surface extending a substantial distance parallel to the pin, whereby a substantial area of sliding contact is provided between said pin and said arch portion to reduce the wear of those parts.

4. The door stop and hold open of claim 1 further comprising attaching means for attaching said detent member selectively at points along the longitudinal dimension of said channel, whereby the door is provided with a selectable detent open position.

5. The door stop and hold of claim 1 further comprising a resilient bumper positioned within said channel between said slidable block and said stop member to prevent abrupt impact of the slidable block against said stop member.

6. An arrestor for use in a door stop and hold open of the type having a channel attached to and parallel with a member of a door mounting frame, the channel having a guide slot in its wall, having a block slidable within the channel, the slidable block having a pin extending through the guide slot for pivotally attaching one end of an arm thereto, the other end of the arm being pivotally attached to a corresponding member of the door frame some distance from the hinge axis, so that as the door is opened, the arm draws the slidable block along the channel toward the hinge axis, said arrestor comprising:

a. a stop member within the channel selectively positionable to a predetermined position along the channel between the slidable block and the door hinge axis to limit the travel of the slidable block within the channel; and b. a detent member having orthogonal longitudinal and lateral axes and being selectively positioned proximate to the slotted wall of the channel with the longitudinal axis parallel to the channel guide slot and the lateral axis transverse the guide slot, comprising a plate portion having a tab depressed to extend partially into the guide slot of the channel to maintain alignment of the detent member with respect to the channel guide slot, and further comprising at least one leaf spring integral with said plate portion and extending substantially in the longitudinal direction so that when said detent member is attached to said channel said at least one leaf spring extends away from the hinge axis along and aligned with said channel, said at least one leaf spring having an arch portion normally extending into the path of said pin along said guide slot so that the pin contacts said arch portion as it moves within said channel guide slot corresponding to a desired detent position of the door, said at least one leaf spring being substantially resilient but having sufficient rigidity to prevent said pin from being pulled past it in the absence of external forces manually applied to the door.

7. The door stop and hold open of claim 6 wherein said detent member has two leaf springs integral with said plate portion, substantially parallel to each other and extending substantially in the longitudinal direction so that when said detent member is attached to the channel said leaf springs extend away from the hinge axis along and aligned with the channel, said leaf springs disposed symmetrically on opposite sides of a plane containing the longitudinal axis and perpendicular to said plate portion, the opposing surfaces of said leaf springs defining a guideway between them, said leaf springs having an arch portion normally extending into the path of the pin along the guide slot so that the pin contacts said arch portions as it moves within the channel guide slot, corresponding to a desired detent position of the door, said leaf springs being substantially resilient but having sufficient rigidity to prevent the pin from being pulled past it in the absence of external forces manually applied to the door.

8. The door stop and hold of claim 6 wherein said arch portion has a surface contacted by the pin as it moves within the channel, said surface extending a substantial distance parallel to the pin, whereby a substantial area of sliding contact is provided between the pin and said arch portion to reduce the wear of those parts.

9. The door stop and hold open of claim 6 further comprising attaching means for attaching said detent member selectively at points along the longitudinal dimension of the channel, whereby the door is provided with a selectable detent open position.

10. The door stop and hold of claim 6 further comprising a resilient bumper positioned within the channel between the slidable block and said stop member to prevent abrupt impact of the slidable block against said stop member.

11. In a door stop and hold open of the type having a channel attached to and parallel with a member of a door mounting frame, the channel having a guide slot in its wall, having a slidable block inside the channel and slidable along it, the slidable block having a pin extending through the guide slot for pivotally attaching one end of an arm thereto, the other end of the arm being pivotally attached to the door at a point removed from the hinge axis, so that as the door is opened, the arm draws the slidable block along the channel toward the hinge axis, having a stop member within the channel selectively positionable to a predetermined position along the channel between the slidable block and the door hinge axis to limit the travel of the slidable block, the improvement comprising:

a detent member having orthogonal longitudinal and lateral axes and being selectively positioned proximate the slotted wall of the channel with the longitudinal axis parallel to the channel guide slot and the lateral axis transverse to the channel guide slot, said detent member comprising a plate portion having a tab depressed to extend partially into the guide slot of the channel to maintain alignment of the detent member with respect to the channel guide slot, and further comprising at least one leaf spring integral with the plate portion, and extending substantially in the longitudinal direction so that when said detent member is attached to the channel said at least one leaf spring extends away from the hinge axis along and aligned with the channel, said at least one leaf spring having an arch portion normally extending into the path of the pin along the guide slot so that the pin contacts said arch portion as it moves within the channel guide slot corresponding to a desired detent position of the door, said at least one leaf spring being substantially resilient but having sufficient rigidity to prevent the pin from being pulled past it in the absence of external forces normally applied to the door.

12. The door stop and hold of claim 11 wherein said arch portion has a surface contacted by the pin as it moves within the channel, said surface extending a substantial distance parallel to the pin, whereby a substantial area of sliding contact is provided between the pin and said arch portion to reduce the wear of those parts.

13. The door stop and hold open of claim 11 further comprising attaching means for attaching said detent member selectively at points along the longitudinal dimension of the channel, whereby the door is provided with a selectable detent open position.

14. The door stop and hold open of claim 13 wherein the attaching means comprises:

a threaded hole in the stop member adjacent the channel guide slot;

a hole extending through said detent member at a position alignable with said threaded hole and the channel guide slot;

a screw adapted to be inserted through said detent member hole and tightened within said threaded hole to secure the stop member and said detent to the channel.

15. The door stop and hold of claim 14 further comprising a resilient bumper positioned within the channel between the slidable block and the stop member to prevent abrupt impact of the slidable block against the stop member.

16. In a door stop and hold open of the type having a channel attached to and parallel with a member of a door mounting frame, the channel having a guide slot in its wall, having a slidable block inside the channel and slidable along it, the slidable block having a pin extending through the guide slot for pivotally attaching one end of an arm thereto, the other end of the arm being pivotally attached to the door at a point removed from the hinge axis, so that as the door is opened, the arm draws the slidable block along the channel toward the hinge axis, having a stop member within the channel selectively positionable to a predetermined position along the channel between the slidable block and the door hinge axis to limit the travel of the slidable block, the improvement comprising:

a detent member having orthogonal longitudinal and lateral axes and being selectively positioned proximate the slotted wall of the channel with the longitudinal axis parallel to the channel guide slot and the lateral axis transverse to the channel guide slot, said detent member comprising a plate portion having a tab depressed to extend partially into the guide slot of the channel to maintain alignment of the detent member with respect to the channel guide slot, said detent member having two leaf springs integral with the plate portion, substantially parallel to each other and extending substantially in the longitudinal direction so that when said detent member is attached to the channel the leaf springs extend away from the hinge axis along and aligned with the channel, said leaf springs disposed symmetrically on opposite sides of a plane containing the longitudinal axis and perpendicular to said plate portion, the opposing surfaces of said leaf springs defining a guideway between them, said leaf springs having an arch portion normally extending into the path of the pin along the guide slot so that the pin contacts said arched portions as it moves within the channel guide slot, corresponding to a desired detent position of the door, said leaf springs being substantially resilient but having sufficient rigidity to prevent the pin from being pulled past it in the absence of external forces manually applied to the door.

* * * * *

UNITED STATES PATENT OFFICE

CERTIFICATE OF CORRECTION

Patent No. 3,986,742 Dated October 19, 1976

Inventor(s) JAMES J. HEANEY

It is certified that error appears in the above-identified patent and that said Letters Patent are hereby corrected as shown below:

In the Drawings, FIG. 2 in the top central portion of the drawing, the reference numeral "46" leading to the curved arrow should be -- 47 --;

Column 4, line 14, after "member" the reference numeral "24" should be -- 42 --;
Column 4, line 16, after "member" the reference numeral "24" should be -- 42 --;
Column 4, line 18, after "member" the reference numeral "24" should be -- 42 --; and
Column 4, line 29, after "direction" the reference numeral "46" should be -- 47 --.
Column 5, line 63, after "frame member" the reference numeral "24" should be -- 42 --.

Signed and Sealed this

Tenth Day of April 1979

[SEAL]

Attest:

RUTH C. MASON
Attesting Officer

DONALD W. BANNER
Commissioner of Patents and Trademarks